US005469580A

United States Patent [19]

Sobol

[11] Patent Number: 5,469,580

[45] Date of Patent: Nov. 28, 1995

[54] SHAMPOO CAPE

[76] Inventor: Brigitte Sobol, 9 S. 336 Florence Ave., Downers Grove, Ill. 60516

[21] Appl. No.: 335,169

[22] Filed: Nov. 7, 1994

[51] Int. Cl.[6] ..... A41D 13/00

[52] U.S. Cl. ..... 2/50; 2/48; 2/49.1; 2/49.4; 2/174

[58] Field of Search ..... 2/46, 48, 49.1, 2/49.2, 49.3, 49.4, 49.5, 50, 51, 52, 69, 104, 105, 106, 174, 243.1, 244; 132/319, 285, 212, 270, 216

[56] References Cited

U.S. PATENT DOCUMENTS 83,120 10/1868 Mott ..... 2/49.3
2,310,486 11/1942 Weilerstein ..... 2/174 X
2,357,461 9/1944 Ellinger ..... 2/50
2,600,392 6/1952 Cancell ..... 2/174
2,600,557 6/1952 Marriott ..... 2/174
4,186,443 2/1980 Britzman ..... 2/49.1
4,605,017 8/1986 Thompson et al. ..... 2/174 X
4,611,354 9/1986 Jones ..... 2/174

*Primary Examiner*—Jeanette E. Chapman
*Attorney, Agent, or Firm*—Patnaude, Videbeck & Marsh

[57] ABSTRACT

A shampoo cape has a generally rectangularly shaped web of pliable material and along the sides of the web are semi-rigid elongate side members. The device is held in position against the neck of a person whose hair is being shampooed by a detachable strap.

4 Claims, 2 Drawing Sheets

SHAMPOO CAPE

The present application relates to a cape used for the shampooing of a persons' hair, and in particular to a flexible cape.

BACKGROUND OF THE INVENTION

A person who desires to have his or her hair professionally shampooed generally sits in a chair which is reclined backwards with the back of the person's head resting against the upper ridge of a sink such that water applied to the hair will run into the sink. Trays are available which assist in the shampooing of hair by receiving water applied to the hair and directing it towards a sink. Existing devices consist of a substantially rigid tray with generally inflexible sides which are symmetrically shaped such that the device is best used, or only usable, when positioned directly behind the person whose hair is to be shampooed. Even when used directly behind a person, the operator must hold the device in the desired position which causes stress to the upper back of the operator.

Disabled or elderly people, however, are often unable to recline back either because of the existence of a wheel chair, or because of their general infirmity. The difficulty is further compounded because such elderly or disabled people often have frail, thin necks, and their body, including their jaws and shoulders, are sensitive. When existing devices are positioned against the side of the neck for such people, the device must be managed carefully if the operator is to avoid causing discomfort to the customer.

Even when great care is used, existing devices cannot deform to the shape of the customer's neck and shoulders and still provide a ramp to direct water away from the customer as desired. As a result, it is often difficult to shampoo the hair of a disabled or elderly person without running a great deal of water on the person's clothing or on the floor.

It would, therefore, be desirable to provide a tray or other device which can direct water from a person's hair toward the person's side. It would further be desirable that a tray have flexibility so that it will conform to the shape of a person's shoulder and neck, without causing pain or injury to the customer whose hair is being shampooed.

SUMMARY OF THE INVENTION

Briefly, the present invention is embodied in a shampoo cape having a web of pliable material or a fabric, which is generally rectangular with a first and second end and opposing sides. Each of the opposing sides are generally straight and parallel to each other, and the first end is perpendicular to the sides with square corners at the intersection of the sides and the first end. The corner of the second end are rounded and the midsection of the second end has an arcuate indentation adapted to fit against a persons' neck. A semi-rigid elongate side member extends along each of the opposing sides and portions of the second end on each side of the arcuate indentation, and the device is retained against a person's neck by a strap.

GENERAL DESCRIPTION OF THE DRAWINGS

A better understanding of the present invention will be had by a reading of the detailed description of the preferred embodiment taken in conjunction with the drawings wherein.

DETAILED DESCRIPTION OF A PREFERRED EMBODIMENT

Figure 1:
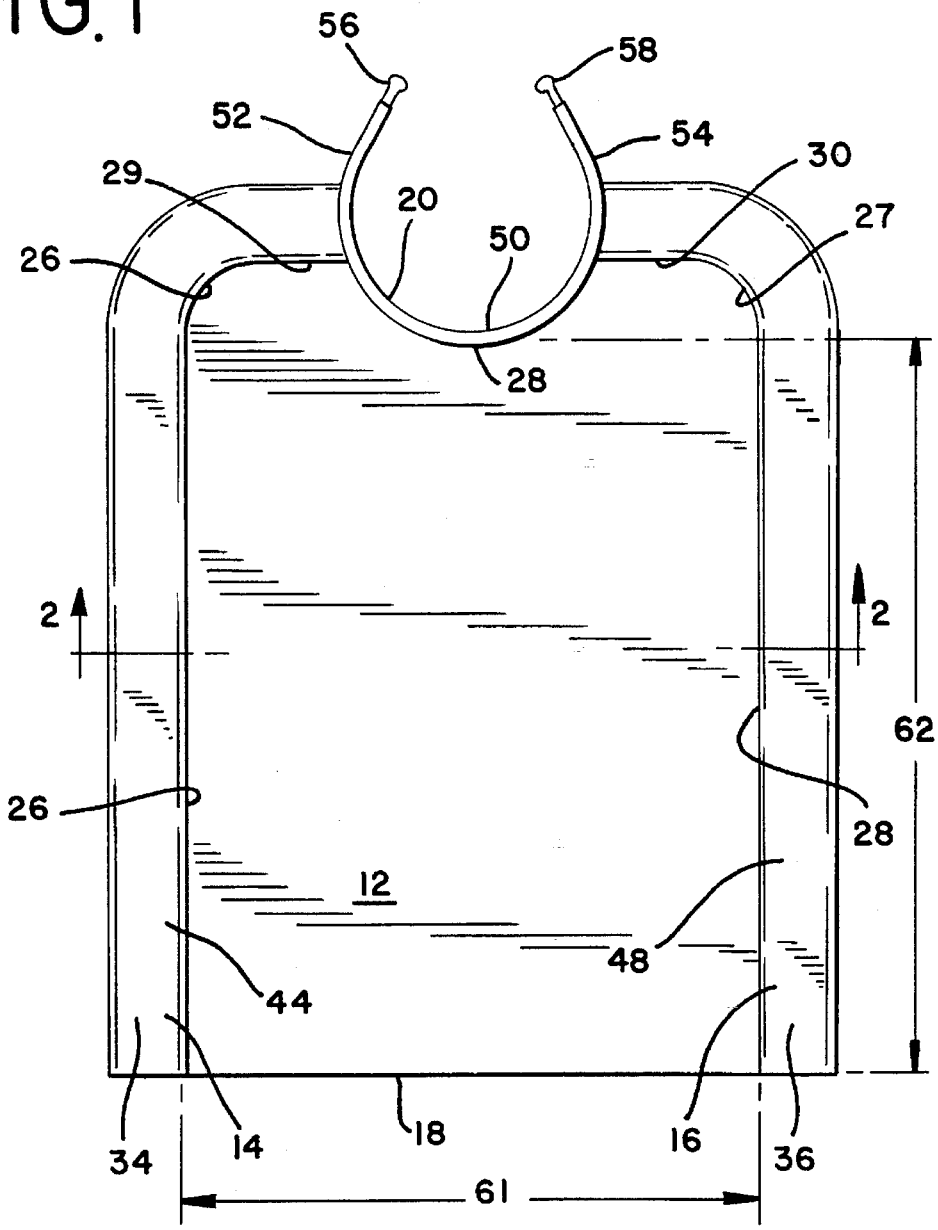
FIG. 1 is a top plan view of a hair dresser's tray in accordance with the present invention.
Figure 2:
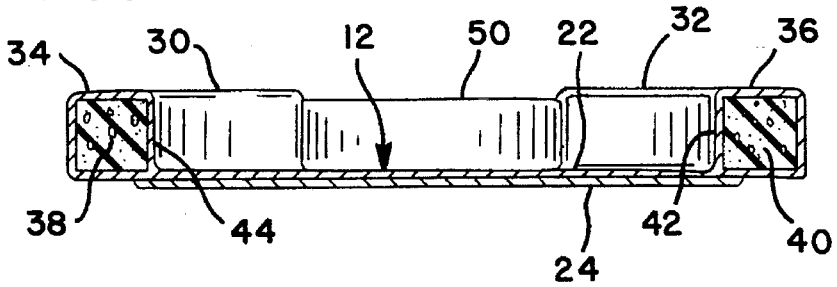
FIG. 2 is a cross-sectional view of the tray shown in FIG. 1 taken through lines 2—2 thereof.
Figure 3:
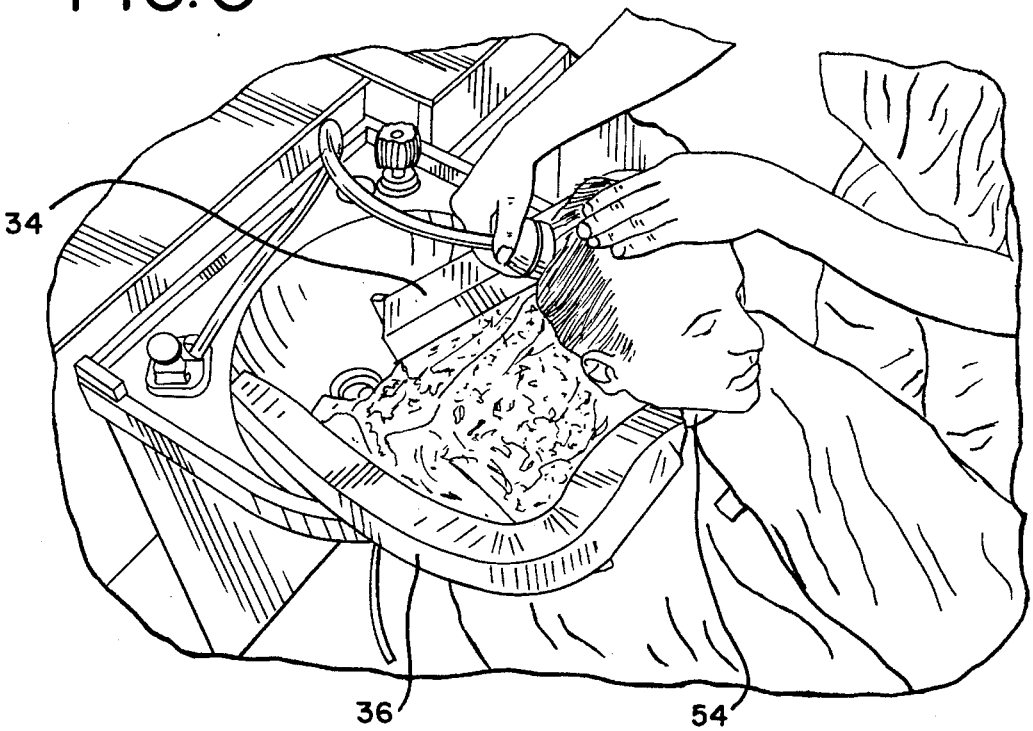
FIG. 3 is a perspective view of a cape in accordance with the present invention fitted on a person having his or her hair shampooed with the cape extending over the rear of the chair.
Figure 4:
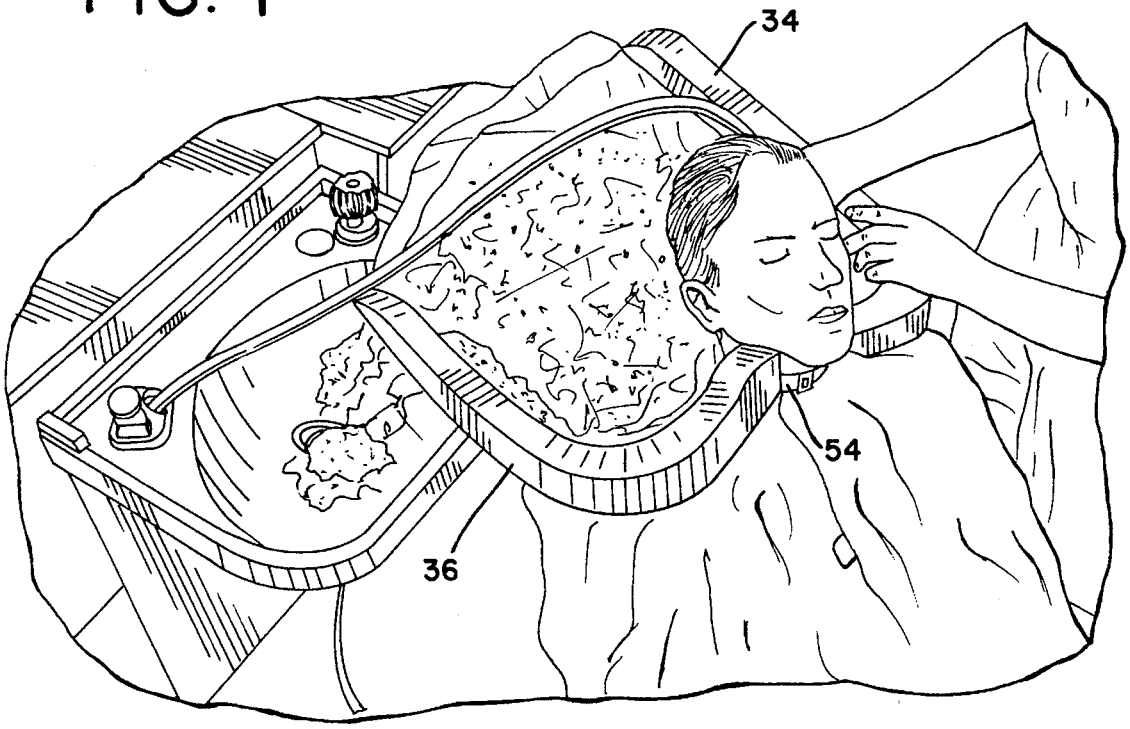
FIG. 4 is a perspective view of a cape in accordance with the present invention fitted on a person having his or her hair shampooed with the cape extending over one side of the chair.

Referring to FIG. 1, a hairdresser's tray 10 has a generally rectangularly shaped web portion 12 which has opposing sides 14, 16, a first end 18 and a second end 20. As can be seen in FIG. 2, the web 12 may have an upper layer 22 which is made of a pliable material with good waterproof qualities, such as a nylon fabric, and a second lower layer 24 of a pliable plastic which is impervious to water. It is important that the two layers of the web have the pliability of a fabric so that the web may conform to the shape of the objects and body parts around which it is fitted.

As can be seen in FIG. 1, the first end 18 is substantially straight, as are the opposing sides 14, 16, respectively, which are generally parallel to each other and form square corners with the first end 18. At the intersection of the sides 14, 16 with the second end 20, there are rounded sections 26, 27, respectively.

The second end 20 of the web 12 has an arcuate indentation 28 positioned midway along its length such that two straight portions 29, 30 extend between the sides 14, 16 and the arcuate indentation 28, respectively. Along side 14, rounded section 26, and straight second end portion 29, is a first side member 34, and along side 16, rounded section 27 and straight second end portion 30 is a second side member 36.

It is desirable that the first and second side members 34, 36 have sufficient rigidity to maintain borders at the edges of the web 12 while water runs along the web, and yet have a great deal of flexibility. As best shown in FIG. 2, in a preferred embodiment, the interior of the side members 34, 26 are elongate strips of foam rubber 38, 40. Foam rubber is particularly desirable for use in the side members 34, 36 because it has sufficient rigidity to maintain borders for directing the flow of water, yet is very flexible, so as to deform against a person's neck or shoulder without causing pain or discomfort. To secure the elongate strips of foam rubber 38, 40 adjacent the opposite sides 14, 16 of the web 12, the material which comprises the upper layer 22 of the web 12 is sufficiently long such that end portions 42, 44, respectively, of the upper layer 22 can be wrapped around the foam rubber inserts 38, 40, respectively. A stitching 46, 48 along the inner edge of the side members 34, 36 retains the parts in assembled relationship.

A border 50 extends around the arcuate indentation 28 of the second end 20 and is shaped to extend upwardly and perpendicular to the general plane of the web 12. Extending from the ends of the border 50, are first and second strap portions 52, 54, respectively, which can be positioned around the neck of a person to retain the device. The free ends of the strap portions 52, 54, have complementary portions 56, 58 of a connector. Any suitable connector portion such as sold under the trademark VELCRO can be used to retain the ends together. Snaps or a buckle can also be used to retain the ends of the strap 52, 54 attached to each other.

In the preferred embodiment, the web 12 should have a width 61 between sides 14, 16 and along the first end 18 of approximately 18 inches. The web 12 should further have a length 62 extending from the central portion of the second end 20 to the first end 18 of approximately 22 inches. To maintain the desired balance of rigidity and flexibility, the foam rubber inserts 38, 40 should each have a square cross-sectional shape which are between one and one-half and two and one-half inches on each side. The strap portions 52, 54 in the preferred embodiment are elastomeric. When the strap portions 52, 54 are positioned around the neck of a person, the elastomeric strap portions will retain the border 50 of the second end 20 against the neck of a person whose hair is being shampooed, such that water will not run down the person's neck during the shampooing process.

A shampoo tray as described above is highly flexible and can be fitted on a person who is in a high back wheel chair or a short person in an ordinary wheel chair who is unable to tilt his or her head backward as is required with existing shampoo aids. The device can be positioned with one of the side members 34, 38 on the forward side of the person's shoulder and the other side member 34, 36 on the rearward side of the shoulder with the first end 18 directed towards a sink to receive water draining from the hair. Where the inserts 38, 40 of side members 34, 36 are of foam rubber, the side members will have sufficient rigidity to provide edges to the web 12 to confine and direct water flowing upon the web 12, and yet retain a high degree of flexibility. The foam rubber inserts may further be deformed to conform to the shape of a person's shoulder and arm with a minimum of pressure against the body of a person and avoiding the pain inflicted by the use of existing shampooing aids.

While the present invention has been described in connection with one embodiment, it will be understood by those skilled in the art that changes and modifications may be made without departing from the true spirit and scope of the present invention. Therefore, it is intended by the appended claims to cover all such changes and modifications which come within the true spirit and scope of the present invention.

What is claimed:

1. A hairdresser's cape comprising in combination:

a web of material having the pliability of a fabric, having a first end and a second end and opposing sides;

said opposing sides being substantially parallel to each other;

said second end having an arcuate indentation for being positioned against the neck of a person;

first and second semirigid elongate side members, each of said side members including a foam rubber insert, one of said side members extending along each of said opposing sides; and strap means for strapping said second end against a person's neck.

2. A hairdresser's tray in accordance with claim 1 wherein said web includes an upper layer made of a nylon material and a lower layer of a plastic material.

3. The hairdresser's tray of claim 2 wherein said web has a length of about 22 inches and a width between said generally straight portions of said side members of about 18 inches.

4. A hairdresser's cape comprising in combination:

a web of material having the pliability of a fabric, having a first end and a second end and opposing sides;

said opposing sides being substantially parallel to each other;

said second end having an arcuate indentation for being positioned against the neck of a person;

first and second semirigid elongate side members, each of said side members having an insert of a flexible foam material, one of said side members extending along each of said opposing sides; and strap means for strapping said second end against a person's neck.

* * * * *